US011480169B2

(12) United States Patent
Repaci

(10) Patent No.: US 11,480,169 B2
(45) Date of Patent: Oct. 25, 2022

(54) COMPRESSOR VALVE AND FILTER ARRANGEMENT

(71) Applicant: MGF S.r.l., Abbiategrasso (IT)

(72) Inventor: Massimo Repaci, Milan (IT)

(73) Assignee: MGF S.R.L., Abbiategrasso (IT)

( * ) Notice: Subject to any disclaimer, the term of this patent is extended or adjusted under 35 U.S.C. 154(b) by 89 days.

(21) Appl. No.: 16/633,324

(22) PCT Filed: Jul. 24, 2018

(86) PCT No.: PCT/IB2018/055508
§ 371 (c)(1),
(2) Date: Jan. 23, 2020

(87) PCT Pub. No.: WO2019/021182
PCT Pub. Date: Jan. 31, 2019

(65) Prior Publication Data

US 2020/0158102 A1 May 21, 2020

(30) Foreign Application Priority Data

Jul. 27, 2017 (IT) ..... 102017000086453

(51) Int. Cl.
*F04B 39/16* (2006.01)
*F04B 39/10* (2006.01)
(Continued)

(52) U.S. Cl.
CPC ..... *F04B 39/16* (2013.01); *F04B 39/10* (2013.01); *F04B 41/02* (2013.01); *F04B 35/06* (2013.01)

(58) Field of Classification Search
CPC ..... F04B 39/16; F04B 39/10; F04B 35/06
See application file for complete search history.

(56) References Cited

U.S. PATENT DOCUMENTS 4,670,223 A * 6/1987 Delachapelle ..... A61M 16/10 96/130
5,087,178 A * 2/1992 Wells ..... B01D 53/261 418/1

(Continued)

FOREIGN PATENT DOCUMENTS

CN 102678523 9/2012
CN 202014123 5/2013

(Continued)

OTHER PUBLICATIONS

English Machine translation of description of JP-63235678-A (Year: 1988).*

(Continued)

*Primary Examiner* — Nathan C Zollinger
(74) *Attorney, Agent, or Firm* — Tutunjian & Bitetto, P.C.

(57) ABSTRACT

A compression unit including at least one volumetric compressor for compressing the air drawn from the external environment, a system for drying the compressed air operatively associated to the at least one volumetric compressor, one tank for storing the compressed air delivered from the at least one volumetric compressor, wherein the drying system comprises a unit for cooling the compressed air positioned downstream of and placed in fluid communication with the tank, and one dryer positioned upstream and placed in communication with the cooling unit, the dryer configured to reduce the moisture content present in the compressed air that can be dispensed by the compression unit, one solenoid valve positioned upstream of the dryer, to shut off the flow of compressed air flowing out from the tank, and a differential pressure switch to control the switching of the solenoid valve.

9 Claims, 3 Drawing Sheets

(51) Int. Cl.
*F04B 41/02* (2006.01)
*F04B 35/06* (2006.01)

(56) References Cited

U.S. PATENT DOCUMENTS

| | | | | |
|---|---|---|---|---|
| 5,443,369 | A * | 8/1995 | Martin | F04D 29/102 417/313 |
| 2015/0361975 | A1 * | 12/2015 | Kouzel | F04B 49/08 417/53 |
| 2016/0138578 | A1 | 5/2016 | White et al. | |

FOREIGN PATENT DOCUMENTS

| | | | | |
|---|---|---|---|---|
| DE | 20307238 | | 7/2003 | |
| DE | 20307238 | U1 * | 7/2003 | F04B 39/16 |
| JP | S58142385 | | 9/1983 | |
| JP | S599190 | | 1/1984 | |
| JP | 63235678 | A * | 9/1988 | |
| JP | H0560071 | | 3/1993 | |
| JP | 08093701 | A * | 4/1996 | |
| JP | 2881647 | | 4/1999 | |
| JP | 2004019443 | | 1/2004 | |
| JP | 2005220750 | | 8/2005 | |
| JP | 2012237299 | | 12/2012 | |

OTHER PUBLICATIONS

English Machine translation of description of DE-20307238-U1 (Year: 2003).*
English Machine Translation of Abstractor JP-08093701-A (Year: 1996).*
International Search Report for PCT/IB2018/055508 dated Oct. 2, 2018 (3 pages).

* cited by examiner

COMPRESSOR VALVE AND FILTER ARRANGEMENT

TECHNICAL FIELD OF THE INVENTION

The present invention regards a compression unit for compressing and drying an operating fluid such as air drawn from the environment.

STATE OF THE ART

Compression units comprising at least one volumetric compressor of the reciprocating type, i.e. a compressor in which the compression of an operating fluid corresponding to air is determined by the reciprocating straight motion of a plunger in a respective cylinder, are known.

The air to be compressed is drawn from the external environment and it is filtered prior to being compressed. The air filtering process is required so as to prevent the impurities, dirt or dust in particular, from entering into the compressor, thus jeopardizing the functionality thereof and contaminating the compressed air that can be dispensed by the compressor.

As known, ambient air has a given moisture content which, subsequently to the compression process, can condensate or not condensate and facilitate the formation of rust or generate further problems.

The use of a drying system or other technical solutions in order to reduce the moisture content present in the air to be compressed or in the compressed air is known.

With reference to the latter, for example, compression units without a drying system, in which the operating fluid—compressed air—is directly stored in the tank thus keeping the moisture content of the air drawn from the environment and filtered intact.

A vent valve that can be actuated manually or automatically, for example by means of a timed solenoid valve, can be provided with the aim of removing any condensate formed inside the tank.

On the contrary, should there be provided for a system for drying the operating fluid, the use of a dryer, for example of the membrane, absorption or refrigeration type, suitable to reduce the moisture content present in the operating fluid, is known.

JPH0560071 A describes an air compression unit, of the mechanical lubrication type, comprising a heat exchanger and a drying unit, configured to enable the air-condensate separation.

Generally, it is observed that the installation position of the dryer in the compression unit may vary as a function of the power of the compressor and the required performance and thus, for example, the dryer can be positioned between the compressor and the tank, in case of low power demand, or downstream of the compression unit (thus both of the compressor and of the tank) in case of medium/high power demand, indicatively exceeding 10 kW.

Should a drying system be provided for, a control and actuation system suitable to control the steps for switching the compression unit and the drying unit ON and OFF is provided.

However, such control system is separated from the compression unit.

With reference to the applications that require low power and comprising a drying system, in the industry there arises the need for providing a highly efficient compression unit for an integrated solution and for ease of use.

SUMMARY OF THE INVENTION

The main object of the present invention is to improve the prior art regarding a compression unit suitable to compress air drawn from the environment.

In this context, an object of the present invention is to provide a compression unit capable of guaranteeing an effective and efficient treatment of the operating fluid—air—intended as filtering and drying it.

A further object of the present invention is to provide a compression unit suitable to operate with lesser actuation times with respect to those of conventional solutions considering the same type of appliance to be supplied.

Another object of the present invention is to provide a compression unit comprising a drying system capable of operating with optimized operating pressure and temperature parameters, with the aim of preserving the state of the components of the drying system.

A further object of the present invention is to provide a compression unit in which air wastage is reduced to the minimum.

In this context, an object of the present invention is to provide a compression unit according to the present application.

The present application refers to preferred and advantageous embodiments of the invention.

BRIEF DESCRIPTION OF THE DRAWINGS

Further characteristics and advantages of the present invention shall be more apparent from the detailed description of a preferred but non-exclusive embodiment of a compression unit, for compressing air that can be drawn from the environment, illustrated by way of non-limiting example in the attached drawings, wherein.

DETAILED DESCRIPTION OF THE INVENTION

Figure 1:
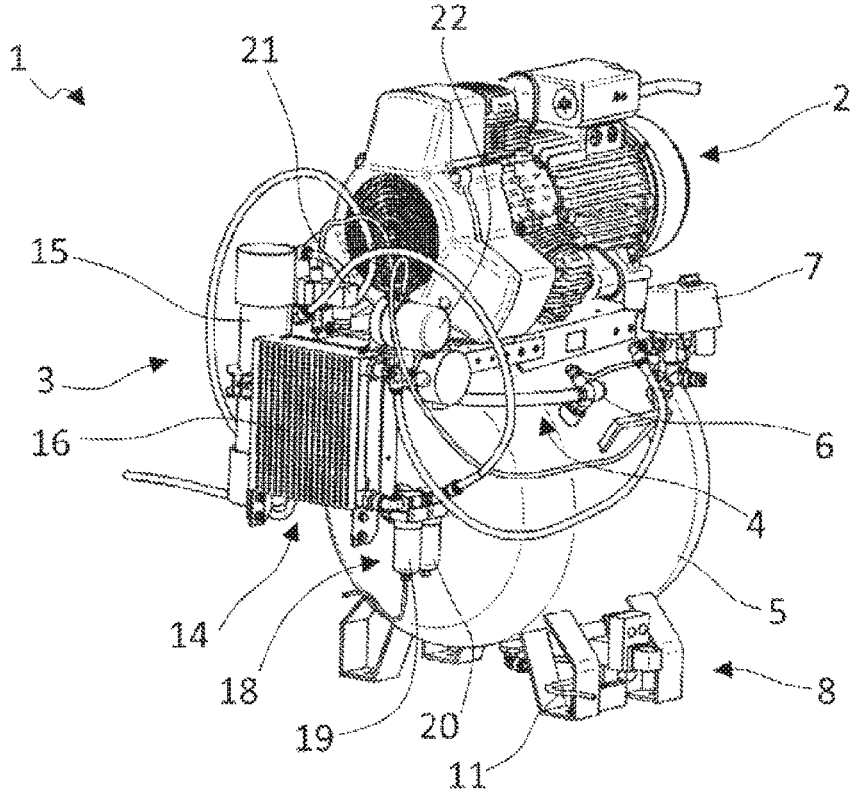
FIG. 1 is a perspective view of a compression unit according to the present invention.

With reference to the attached figures, a compression unit according to the present invention is generally indicated with reference number 1.

The compression unit 1 comprises at least one volumetric compressor 2, suitable to compress an operating fluid such as air drawn from the external environment with respect to the compressor, and a drying system 3 operatively connected to the at least one volumetric compressor 2.

The drying system 3 is suitable to adjust the moisture content present in the compressed air flowing out from the compression unit 1, according to the methods described hereinafter.

The at least one volumetric compressor 2 is of the reciprocating type and, thus, it comprises at least one plunger that can be actuated with a reciprocating motion in the respective cylinder, by carrying out the steps for suctioning, compressing and discharging the operating fluid to be compressed.

In particular, such at least one volumetric compressor 2 can be of the type without being assisted by additional or so-called "dry" lubrication which, with respect to compressors of the type assisted by additional lubrication, does not introduce any lubricating content into the operating fluid, thus guaranteeing a superior air quality. In compressors of the type assisted by additional lubrication, instead, an amount of lubricant inevitably passes through the motor-connecting rods system to the compression chambers due to the tolerances present between the dynamic and static elements, introducing a percentage of the lubricating element into the operating fluid and thus deteriorating the quality thereof.

The at least one volumetric compressor 2 may comprise a filter for filtering the air drawn from the external environment according to the purposes described previously regarding the prior art.

The air to be compressed is drawn from the external environment through special openings provided for in the compression unit 1, not illustrated in detail in the attached figures.

The operation of the reciprocating volumetric compressor is deemed known and will be described herein solely regarding aspects that can facilitate the intelligibility of the present invention.

During the operation of the compression unit 1, the temperature of the air flowing out from the at least one volumetric compressor 2 is high due to the compression to which the air is subjected and the friction between the rotating parts.

Subsequently to the compression step, the air flowing out from the at least one volumetric compressor 2 is sent to a tank 5 (for example see FIG. 1) by means of the special delivery line 4.

It is observed that a check valve 6 in an interposed position between the outlet of the at least one volumetric compressor 2 and the inlet of the tank 5, which is configured to prevent the inversion of the motion of the operating fluid advancing towards the tank 5, is provided along the delivery line 4.

The compression unit 1 comprises control means, indicated in their entirety with 7, suitable to selectively control the actuation of the at least one volumetric compressor 2 as a function of the pressure value detected inside the tank 5.

According to a version of the present invention, the control means 7 comprise a pressure switch and they are operatively connected to the volumetric compressor 2 and to the tank 5, with the aim of detecting the pressure value inside the latter, and comparing it with the pre-established reference values (see FIG. 1).

In particular, upon detecting a lower pressure value inside the tank 5 with respect to a pre-established minimum pressure, the control means 7 control the actuation of the at least one volumetric compressor 2, thus causing the introduction of new compressed air into the tank 5 and, hence, the increase of the pressure value present therein.

Upon detecting a pressure value inside the tank 5 equivalent to a pre-established maximum value, the control means 7 control the stop of the volumetric compressor 2.

The control means 7 can control the selective supply of an electric motor operatively connected to the volumetric compressor 2 with the aim of controlling the actuation of the at least one plunger inside the respective at least one cylinder by means of a straight alternating motion.

According to a version of the present invention, at the end of the operating cycle of the at least one volumetric compressor 2, once the pressure value reaches a pre-established maximum value inside the tank 5, the control means 7 provide for discharging any pressurized air present inside the delivery line 4, in the section upstream of the check valve 6, subsequently to the stop of the at least one volumetric compressor 2.

This action is carried out through a pneumatic discharge system or the switching of a control solenoid valve operatively associated to the delivery line 4 and to the control means 7.

Actually, eliminating the overpressure present in the delivery line 4 facilitates the acceleration of the volumetric compressor 2 to a subsequent re-start, in that it does not have to overcome the resistance caused by such overpressure present flowing out from the at least one volumetric compressor 2.

As known, the operating fluid expands when flowing into the tank 5 and thus cools due to the aforementioned expansion.

The moisture present in the compressed air, following the cooling of the latter, precipitates in form of condensate that sticks along the inner walls of the tank 5. This condensate accumulates at the bottom of the tank by gravity.

The compression unit 1 may comprise an automatic system for discharging the condensate from the tank 5, indicated in its entirety with 8.

According to a version of the present invention, the discharge system 8 may comprise a first duct 9 in fluid communication, at a first end 9', with the internal of the tank 5 by means of a valve 10. The first duct 9 has a second end 9", opposite to the first 9', which is operatively associated to a discharge duct 11.

The discharge system 8 may comprise a solenoid valve 12 interposed between the second end 9" of the first duct 9 and the discharge duct 11.

The opening or closing of the solenoid valve 12 selectively places the first duct 9 in fluid communication with the discharge duct 11, to enable or hinder the discharge of the condensate from the tank 5.

According to a version of the present invention, the solenoid valve 12 can be associated to a timer 13 suitable to selectively control the activation thereof and, thus, the opening at predefined intervals and for a pre-set period of time, thus enabling the discharge of the condensate from the tank 5.

The frequency and duration at which the solenoid valve 12 is held at open position can be adjusted by a user as a function of the of the specific needs.

As mentioned, the compression unit 1 comprises a drying system 3.

Besides the system 8 for discharging the condensate, the drying system 3 enables adjusting, reducing it, the moisture content present in the compressed air flowing out from the compression unit 1.

Figure 6:
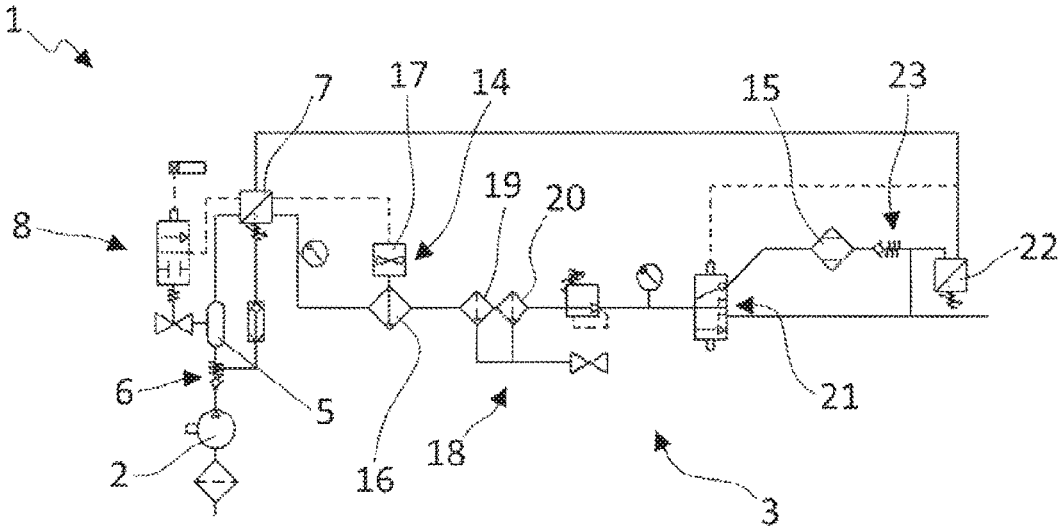
FIG. 6 is a schematic representation of the compression unit according to the present invention.

The drying system 3 is arranged along a section of the operating fluid line present in the compression unit arranged downstream of the tank 5 (see FIG. 6).

The drying system 3 comprises a unit 14 for cooling the fluid and at least one dryer 15 placed in fluid communication with respect to each other.

In particular, the unit 14 for cooling the operating fluid is arranged downstream of the volumetric compressor 2 and the tank 5 and in selective fluid communication with the latter, while the at least one dryer 15 is positioned downstream of the cooling unit 14 and upstream of the appliance to be served.

According to a version of the present invention, the cooling unit 14 comprises a heat exchanger 16, preferably of the coil type, operatively associated to a fan 17 suitable to generate and convey an airflow against the outer walls of the heat exchanger 16 with the aim of increasing heat exchange between the operating fluid traversing the heat exchanger 16 and the surrounding environment.

The compression unit 1 according to the present invention is deemed to possibly comprise a heat exchanger 16 configured differently with respect to what has been described above though falling within the same inventive concept.

The drying system 3 can comprise a filtering unit, indicated in its entirety with 18, interposed between the cooling unit 14 and the dryer 15, and placed in fluid communication with both.

The filtering unit 18 confers a further stage for filtering the operating fluid besides the one initially provided by the filter associated to the at least one volumetric compressor 2.

Figure 2:
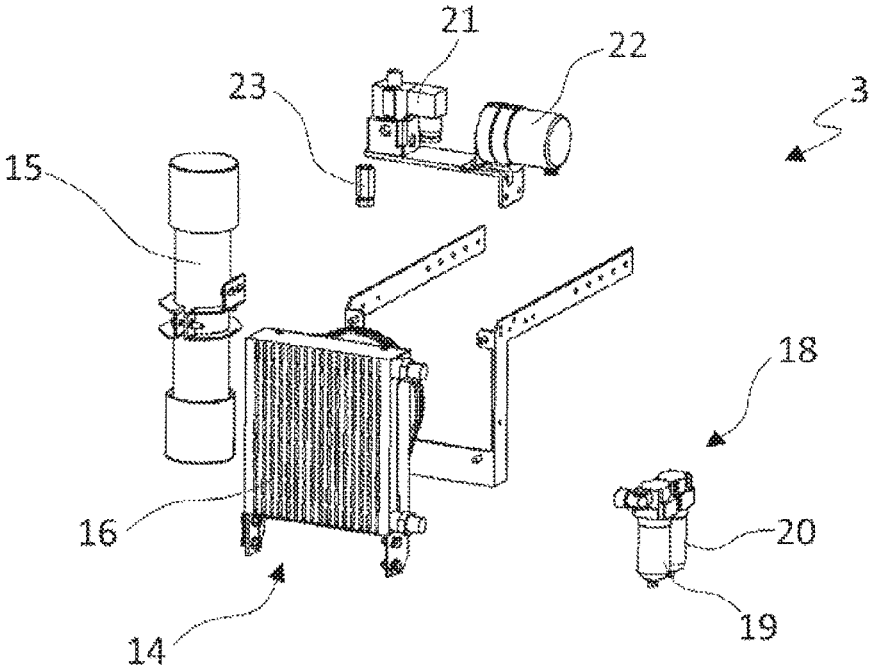
FIG. 2 is an exploded view of some components of the compression unit according to the present invention.
Figure 3:
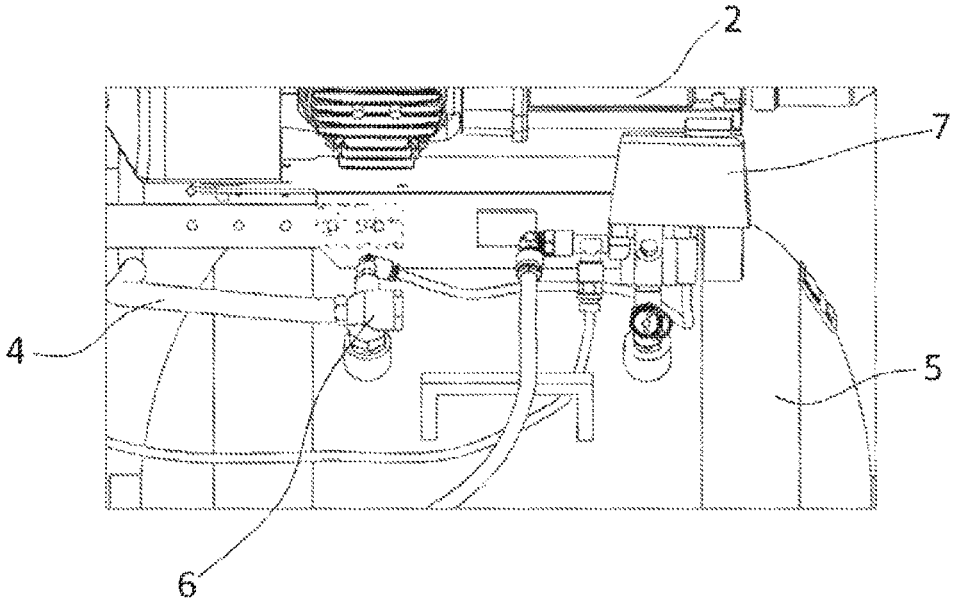
FIGS. 3, 4 and 5 are detailed views of some components of the compression unit according to the present invention.
Figure 4:
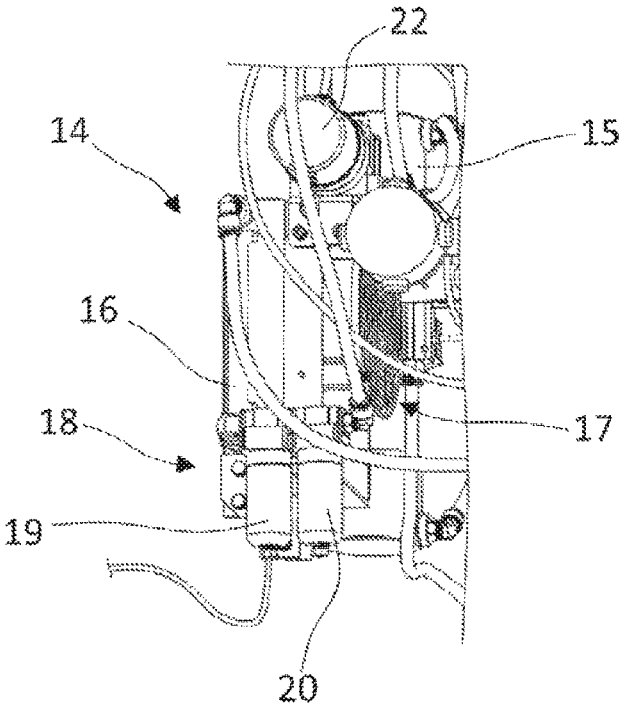
Figure 5:
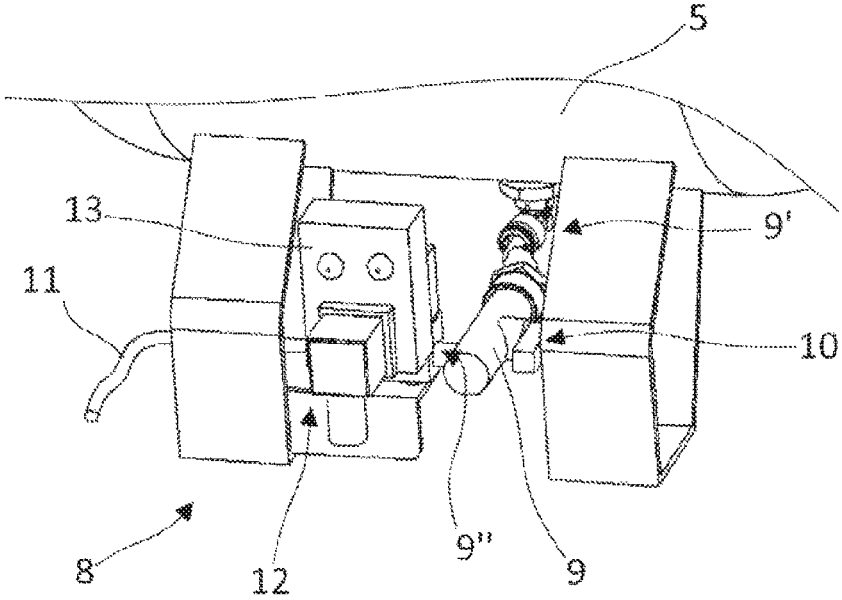

According to a preferred embodiment, the filtering unit 18 may comprise a first filter 19 and a second filter 20 arranged in series with respect to each other (see FIGS. 1, 2 and 4).

The first filter 19 and the second filter 20 may have different filtering capacity with the aim of performing specific and respective tasks when filtering the compressed air flowing out from the cooling unit 14.

By way of example, the first filter 19 may have a lesser filtering capacity with respect to that of the second filter 20.

In particular, the first filter 19 may be optimized to withhold and eliminate any condensate present in the operating fluid delivered from the tank, while the second filter 20 may be optimized to withhold any dust particles contained in the operating fluid.

By way of non-limiting example, the first filter 19 has a filtering capacity or the so-called most penetrating particle size (MPPS) in the order of micrometer units and the second filter 20 has a filtering capacity of hundredths of a micrometer. For example, the first filter may have an MPPS value equivalent to about 5μτι while the second filter may have an MPPS value equivalent to about 0.01μτι.

According to such version of the present invention, the filtering unit 18 also contributes towards reducing the moisture content present in the compressed air that can be dispensed by the compression unit 1.

Downstream of the filtering unit 18, the dryer 15 is provided for, which enables further reducing the moisture content present in the compressed air flowing out from the cooling unit 14, before it is supplied to an appliance.

According to a version of the present invention, the dryer 15 can be of the membrane type, even though the use of further different types is deemed equally possible.

With the aim of optimized the performance of the dryer 15, reducing the stresses to which it is subjected in use, besides limiting the dispersion of compressed air in the compression unit 1, a further solenoid valve 21 suitable to selectively shut off the flow of the air to be sent to the dryer 15 can be provided upstream of said dryer 15.

Should the appliance require the through-flow of the operating fluid, the further solenoid valve 21 is basically switched to the operative position, thus causing the through-flow of the operating fluid coming from the tank 5 through the dryer 15 before reaching the appliance.

Otherwise, i.e. when the through-flow of the fluid to the appliance is not required, the further solenoid valve 21 is actuated to take a shut off position, preventing the flow of the air through the dryer 15 and, thus, any outflow of the so-called purge air from the dryer 15.

This enables limiting the leakage of compressed air flowing out from the compression unit 1, according to the designated purposes.

The compression unit 1 comprises a differential pressure switch 22 suitable to control the switching of the further solenoid valve 21.

The differential pressure switch 22 is associated in fluid communication with the operating fluid delivery line downstream of the tank 5.

More precisely, the differential pressure switch 22 is placed in fluid communication with two different sections of such delivery line with the aim of detecting a pressure difference between a first section and a second section respectively upstream and downstream with respect to the dryer 15. The pressure difference detected by the differential pressure switch 22 is due to the compressed air demand by an appliance served by the compression unit 1.

More in detail, the differential pressure switch 22 is configured to detect the pressure value along the operating fluid delivery line at a point upstream of the dryer 15 and at a point downstream of the dryer 15.

In particular, the point upstream of the dryer 15 is provided at least downstream of the pressure switch 7 associated to the tank 5.

When the appliance associated to the compression unit 1 requires compressed air, the pressure value in the delivery circuit downstream of the dryer 15 reduces with respect to the one upstream of the dryer 15. Such pressure value difference is detected by the differential pressure switch 22 which controls the switching of the further solenoid valve 21 from the shut off position to the through-flow position thus making the operating fluid flowing out from the tank 5 to pass through the drying system 3 and, thus, inside the dryer 15.

Basically, the differential pressure switch 22 controls the various operative steps of the circuit of the compression unit 1 indirectly regarding the reloading of the tank 5 and, directly regarding the subsequent cooling, filtering and drying steps.

When flowing through in the drying system 3, the compressed air flowing out from the tank 5 is further filtered and dried so as to reduce the moisture content thereof up to a pre-established value.

The compression unit 1 may comprise a one-way valve 23, arranged downstream of the dryer 15 and upstream of the appliance to be served so as to prevent the backflow of the compressed air flowing out from the compression unit 15.

It should be observed that the drying system 3 may comprise different types of instruments suitable to detect the through-flow of the operating fluid such as, for example, a flow switch or generally transducers of another type provided they fall within the same inventive concept.

The compression unit 1 according to the present invention enables achieving the proposed objects.

Firstly, the presence of a filtering unit 18 downstream of the cooling unit 14 enables obtaining a further stage for filtering the air to be sent to a user with respect to what occurs in a compression unit of the conventional type which provides for a single filtering stage at the inlet of the air drawn from the environment to be introduced into the unit.

The use of a drying unit 3 according to the present invention, comprises a dryer 15 arranged downstream of the tank 5 and the cooling unit 14 enables the dryer 15 to operate under optimal conditions, reducing the heat and mechanical stresses to which it is subjected.

As a matter of fact, the cooling unit 14 enables reducing the temperature value of the operating fluid prior to the latter being introduced into the dryer 15.

Furthermore, from a mechanical viewpoint, the inner components of the dryer 15 are subjected to an operating fluid pressure value substantially equivalent to the pressure value required by the user.

Such pressure value is lower than the maximum pressure value that the operating fluid has flowing out from the volumetric compressor 2.

The operating fluid pressure value inside the dryer 15 is not subjected to the fluctuation and pulsation phenomena which occur flowing out from the at least one volumetric compressor 2, where the operating fluid pressure varies between a pre-established minimum and maximum value.

Furthermore, it should be observed that the presence of a further solenoid valve 21, operatively associated to the dryer 15, enables reducing the duration of the step of the through-flow of the fluid in the dryer 15, thus limiting the stresses to which it is subjected to the advantage of greater duration of such component over time.

The detected operating time of the compression unit 1 according to the present invention, considering the same capacity of the utilized drying system and the same type of appliance to be supplied, is lesser by up to 40% with respect to the one of the configurations of the conventional type.

Considering the same result to be obtained, deemed as the supply of an appliance, reducing the operating time enables subjecting the drying system 3 to lesser mechanical and heat stresses, thus extending the useful life of the components thereof.

The compression unit 1 according to the present invention enables reaching a dew point lower by even 50% with respect to that of a compression unit of the conventional type with similar power.

It should be observed that using a compression unit 1 according to the present invention enables an overall reduction of the actuation times of the volumetric compressor 2 with respect to those of the solutions of the conventional type, with the relative consequences outlined above as regards the stresses to which the components of the compression unit 1 are subjected.

With respect to the conventional solutions with similar power, the compression unit 1 basically enables reaching a higher drying level, indicatively almost up to 50%.

Furthermore, the compression unit 1 according to the present invention enables, considering the same or substantially the same dew point value that can be obtained using compression units of the conventional type, reducing the actuation time of the at least one volumetric compressor 2 given that the dimensioning of the dryer 15 can be optimised in the present invention.

Last but not least, in the compression unit 1 according to the present invention the single components designated for the compression, filtering and drying of the operating fluid mutually collaborate in synergy in an integrated solution that does not require assistance by external control or command elements.

In the compression unit 1, the single components are positioned and dimensioned so as to reduce the overall dimensions of the unit as a whole, in a solution that is not only easy to use and install but also capable of guaranteeing greater performance with respect to those of the compression units of the conventional type with similar power.

The compression unit 1 described above can be subjected to numerous modifications and variants falling within the scope of protection of the claims that follow.

The invention claimed is:

1. A compression group comprising at least one volumetric compressor for the compression of air drawn from the outside environment, a system for drying the compressed air operatively associated with said at least one volumetric compressor, said compression group comprising a tank for storing the compressed air being delivered from said at least one volumetric compressor, wherein said drying system comprises a group for cooling said compressed air positioned downstream of and in fluid communication with said tank, and a dryer downstream of and in communication with said cooling group, said dryer being configured for reducing the moisture content present in the compressed air dispensable by said compression group, said compression group further comprising a solenoid valve adjacent to and upstream of said dryer, adapted to selectively intercept the flow of compressed air exiting from said tank, and a differential pressure switch, or an instrument adapted to detect the passage of at least a portion of the compressed air exiting from said tank, adapted to drive the switching of said solenoid valve, wherein said differential pressure switch or said instrument is placed in fluid communication with two different sections of the delivery line of the compressed air exiting from said tank in order to detect a difference of the pressure value between a first section downstream and a second section upstream with respect to said dryer.

2. The compression group according to claim 1, comprising a group for filtering said compressed air positioned interposed between and in fluid communication with said cooling group and said dryer.

3. The compression group according to claim 2, wherein said filtering group comprises a first filter and a second filter in series with each other and in mutual fluid communication.

4. The compression group according to claim 3, wherein said first filter and said second filter have respective filtering capacities, said first filter being configured for reducing the moisture content of the compressed air exiting from said cooling group and said second filter being configured for removing possible dust or dirt present in the compressed air exiting from said cooling group.

5. The compression group according to claim 4, wherein said first filter has a filtering capacity on the order of one micrometer and said second filter has a filtering capacity on the order of hundredths of a micrometer.

6. The compression group according to claim 1, comprising drive means adapted to selectively drive the actuation of said at least one volumetric compressor as a function of the value of the pressure inside said tank, wherein said drive means are configured for detecting the value of the pressure within said tank and to compare it with pre-established reference values.

7. The compression group according to claim 6, wherein said drive means comprise a pressure switch.

8. The compression group according to claim 1, comprising an automatic system for discharging possible condensate present in said tank.

9. The compression group according to claim 6, wherein said second section upstream of said dryer is provided at least downstream of said drive means associated with said tank.

* * * * *